United States Patent [19]

Kincaid et al.

[11] 4,323,721

[45] Apr. 6, 1982

[54] ELECTRIC CABLES WITH IMPROVED SHIELDING MEMBER

[75] Inventors: John W. Kincaid, Batavia; Robert E. Ward, Aurora, both of Ill.

[73] Assignee: Belden Corporation, Geneva, Ill.

[21] Appl. No.: 119,866

[22] Filed: Feb. 8, 1980

[51] Int. Cl.[3] ..... H01B 11/06; H01B 9/02

[52] U.S. Cl. ..... 174/36; 174/103; 174/107; 174/108; 174/115; 428/189

[58] Field of Search ..... 174/32, 34, 36, 102 R, 174/103, 104, 105 R, 106 R, 107, 108, 109, 115, 117 R, 117 A, 117 F; 333/243; 361/304; 428/77, 189

[56] References Cited

U.S. PATENT DOCUMENTS

| | | | |
|---|---|---|---|
| 2,919,390 | 12/1959 | Robinson et al. | 361/304 |
| 3,032,604 | 5/1962 | Timmons | 174/36 X |
| 3,274,329 | 9/1966 | Timmons | 174/108 X |
| 3,474,186 | 10/1969 | Hale | 174/109 X |

FOREIGN PATENT DOCUMENTS

| | | | |
|---|---|---|---|
| 739243 | 9/1943 | Fed. Rep. of Germany | 174/103 |

*Primary Examiner*—Laramie E. Askin

*Attorney, Agent, or Firm*—Fitch, Even, Tabin, Flannery & Welsh

[57] ABSTRACT

An improved shielding member and electric cable constructions which utilize this shielding member are described, the design of the shielding member allowing two cable circuits, each consisting of one or more conductors to be wrapped in and electrically isolated by a single shielding member. The shielding member comprises an elongated ribbon of insulating material and a pair of elongated foil strips arranged in a parallel relationship with the ribbon, the foil strips being bonded to opposite sides of the ribbon and each of the foil strips having an elongated edge generally in alignment with opposite elongated edges of the ribbon. The shielding member is wound in a generally S-shaped configuration forming two envelopes, each of the cable circuits being encased in, and electrically isolated by, one of the envelopes.

13 Claims, 5 Drawing Figures

ELECTRIC CABLES WITH IMPROVED SHIELDING MEMBER

The present invention relates to electric cables with an improved shielding member. For proper transmittal of small signals through an electric cable consisting of one or more individual cable circuits each containing one or more conductors, it is sometimes necessary to prevent the individual cable circuits from picking up extraneous voltages from one another or from neighboring electric circuits. If these extraneous voltages are not excluded, they often result in adverse operation of subsequent amplifying equipment. Such foreign or undesired voltages picked up by cable circuits may mask or even destroy the original signals. Therefore, in order to prevent extraneous voltages from being picked up by the cable circuits, it has been common practice to provide metallic shielding wrapped around the individual cables.

One type of metallic shielding commonly used comprises a metallic sleeve composed of copper braid for enveloping a cable, with the copper braid in turn covered with an insulating layer to prevent undesirable ground connections to the shielding. Shielding of this type is relatively expensive to manufacture and relatively bulky and unduly heavy.

Another type of metallic shield commonly used comprises an elongated metallic foil strip having one surface insulated. The shielding can be wrapped about a cable with the insulated surface facing in a direction so as to suitably insulate the metal of the strip and thereby prevent unwanted electrical connections thereto.

However, these embodiments of shielding require the use of a separate shielding member wrapped about each cable which is desired to be electrically isolated.

Accordingly, it is an object of the present invention to provide electrical cables which include an improved shielding member.

Another object of the present invention is to provide an electric cable of the type described which allows two conductors to be electrically isolated with a single shielding member.

Other objects of the present invention in addition to those set forth above will become apparent to those skilled in the art from the following description taken in connection with the accompanying drawings wherein.

Very generally an electric cable constructed in accordance with the present invention comprises at least two cable circuits each consisting of one or more conductors surrounded by an elongated shielding member. The shielding member comprises an elongated ribbon of insulating material and a pair of elongated foil strips arranged in a parallel relationship with the ribbon and being bonded to opposite sides of the ribbon, with each of the foil strips having an elongated edge generally in alignment with opposite elongated edges of the ribbon. The shielding member is wound in a generally S-shaped configuration forming two envelopes, each of the cable circuits being encased in, and electrically isolated by, one of the envelopes.

Figure 1:
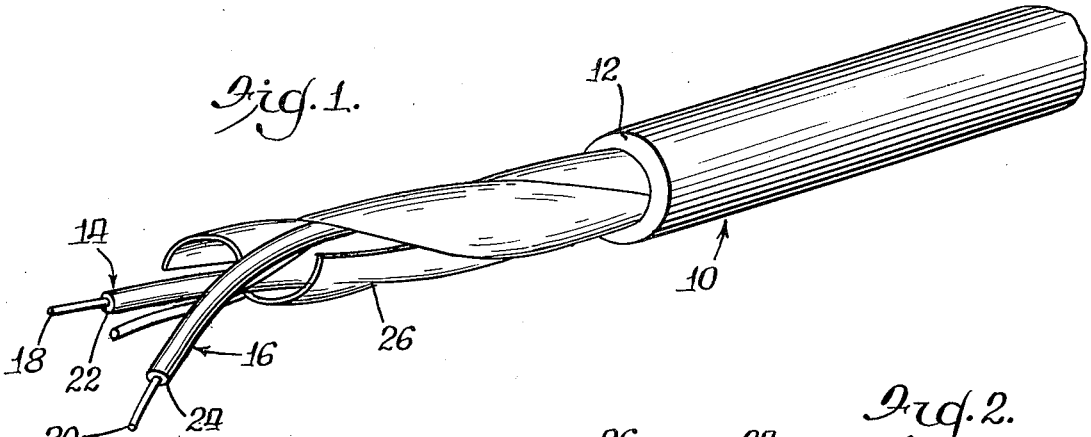
FIG. 1 is a perspective view of an electrical cable formed in accordance with the present invention with a portion of the outer jacket stripped from the inner shielding and insulated conductors.

More specifically in FIG. 1 an electric cable 10 is shown which is utilized to transmit electrical signals in applications such as servomechanism systems, audio systems, etc. A portion of an outer insulation jacket 12 has been removed from the electric cable 10 for illustration purposes. The core of the electric cable 10 comprises a pair of insulated conductors 14 and 16 each including solid or stranded wires 18 and 20 covered in the conventional manner with insulating sleeves 22 and 24 respectively of a material such as rubber, plastic, etc. The conductors 14 and 16 each represent a separate cable circuit, are preferably helically twisted about each other, and are wrapped in an elongated shielding member 26. The wires are preferably helically twisted about each other because this configuration affords better interference isolation characteristics and because a pair of wires twisted about themselves retain their shape. The shielding member 26 is wound in a generally S-shaped helical configuration forming two generally helically shaped envelopes each containing one of the conductors 14 and 16.

Figure 2:
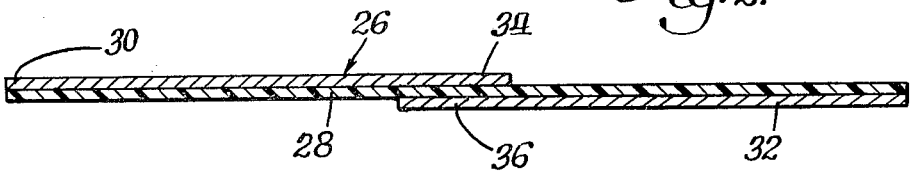
FIG. 2 is a sectional view of one form of shielding members employed in cable structure of the present invention.

In accordance with the present invention a cross-sectional view of the shielding member 26 is shown in FIG. 2. The shielding member 26 comprises a ribbon 28 of insulating material fabricated from a suitable material such as polyethylene terephthalate resin, sold under the trademark "Mylar", tetrafluoroethylene polymer, sold under the trademark "Teflon", vinyl polyethylene, etc. The ribbon 28 is preferably made from a single piece of insulating material, but can be fabricated from multiple pieces of insulating material bonded together. A pair of foil strips 30 and 32 which are fabricated from any of the conducting materials such as copper, aluminum or silver are arranged in a parallel relationship with the ribbon 28, are each bonded to an opposite side of the ribbon 28 and each has an outer elongated edge generally in alignment with opposite elongated edges of the ribbon 28. Preferably the foil strips are of a width slightly larger than half of the width of the insulating ribbon 28 so that the inner elongated edges 34 and 36 of the foil strips 30 and 32 overlap. This offset nature of the shielding and insulating layers of the shielded member 26 allows 100% shield coverage and excellent electrical isolation between the cable circuits.

Figure 3:
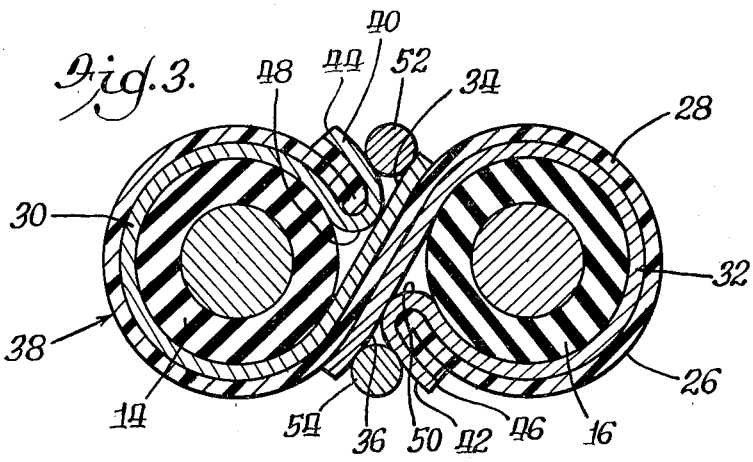
FIGS. 3, 4, and 5 are cross-sectional views of electrical cables containing the shielding member in FIG. 2.

Referring to FIG. 3 a cross-sectional view of the inner core of an electric cable 38 is shown which includes the shielding member 26. It is noted that for illustration purposes the outer insulation jacket is not shown. The shielding member 26 is wrapped in a generally S-shaped configuration with the foil strips 30 and 32 turned in and forming two sealed envelopes, each containing one of the conductors 14 and 16. To insure that the inner elongated edges 34 and 36 contact respective outer elongated edges 40 and 42 of the foil strips 30 and 32 along the length of the shielding member 26, outer elongated edges 44 and 46 of the shielding member 26 are each folded outward in shorting folds 48 and 50 each having a tip which contacts the respective inner edges 34 and 36 of the foil strips 30 and 32.

Located in the interstices outside of the shielding member 26 are drain wires 52 and 54 which each comprise an uninsulated wire conductor preferably of solid material. The drain wire 52 contacts both the inner edge 34 and the outer edge 40 of the foil strip 30, and the drain wire 54 contacts both the inner edge 36 and the outer edge 42 of the foil strip 32. These drain wires are used to provide an easier means to terminate the ground of the cable. Further, since the foil strips have a high D.C. resistance, having the drain wires in contact with the foil strips along the length of the cable reduces the D.C. resistance of the cable ground.

It is noted that the offset nature of the shielding member 26 along with its S-shaped configuration provide excellent isolation between the conductors 14 and 16. By minimizing the offset area of the foil strips 30 and 32 the capacitive coupling between the sealed envelopes is minimized, thereby minimizing leakage of signal between the conductors 14 and 16.

It is also noted that since the foil strips 30 and 32 are spirally wrapped around the conductors 14 and 16 as shown in FIG. 1, at certain frequencies each of the metallic foil strips acts as an inductance, each turn of the foil strips being equivalent to a turn of a coil. To prevent the spirally wound foil strips from acting as an inductance and allowing leakage of unwanted electrical signal to the conductors 14 and 16, the foil strips terminate against themselves along the length of the shielding member, thus shorting each turn of the coil and eliminating the inductive effect.

Figure 4:
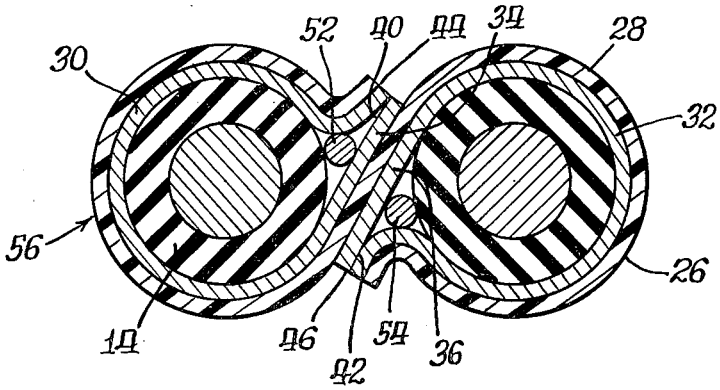

Another embodiment of an electric cable 56 utilizing the shielding member 26 is shown in FIG. 4. As in the previous embodiment the shielding member 26 is wrapped in a generally S-shaped configuration similar to the configuration in FIG. 3. However, in this embodiment the outer edges 40 and 42 of the foil strips 30 and 32 come in direct contact with the inner edges 34 and 36 respectively without shorting folds and with each of the drain wires 52 and 54 located inside one of the envelopes formed by the foil strips 30 and 32 respectively. In this way the shielding member 26 can be used to shield the two cable circuits in a side-by-side relationship without a fold at the outer edges of the shielding member 26.

Figure 5:
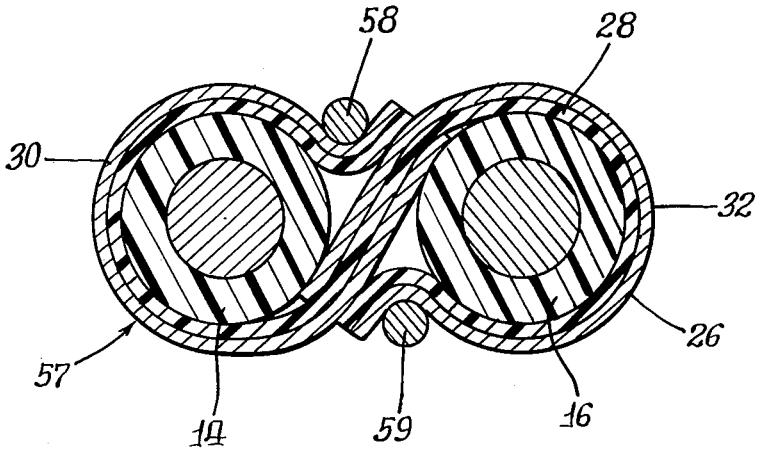

Another embodiment of an electric cable 57 utilizing the shielding member 26 is shown in FIG. 5. In this embodiment the shielding member 26 is also wrapped in a generally S-shaped configuration with, however, the ribbon 28 turned inward against each of the conductors 14 and 16 and without folds at the outside edges. Drain wires 58 and 59 extend along the length of the electric cable 57 and each contacts one of the foil strips. Although not shown in the Figures, one or more of these shielded pairs of cable circuits can be assembled together to make an individual shielded cable with several pairs of shielded cable circuits. A single drain wire would suffice for this embodiment since all the foil shields if properly positioned would be shorted together. This construction would allow for some cross-talk from one twisted pair to the other by leakage along the ribbon 28 of insulating material when the cable was transmitting high frequency signals. The cross-talk could be prevented between paired groups by using shorting folds which fold inward at each edge of the ribbon 28 instead of outward as in FIG. 3, but this would not prevent cross-talk between wires sheathed in the same shielding member.

From the foregoing, it should be appreciated that a novel shielding member and electric cable constructions which utilize this shielding member have been described. The shielding member allows the fabrication of electric cables having two shielded cable circuits isolated from each other and which can be helically twisted about each other while requiring only one shielding member which is formed about the cable circuits in one operation. The unique offset nature of the shielding and insulation layers allows simultaneous 100% shield coverage and excellent isolation between the cable circuits and external circuitry.

It should be understood that although certain preferred embodiments of the present invention have been illustrated and described, various modifications, alternatives and equivalents thereof will become apparent to those skilled in the art and, accordingly, the scope of the present invention should be defined only by the appended claims and equivalents thereof.

Various features of the invention are set forth in the following claims.

What is claimed is:

1. A shielding member helically wound about and shielding at least two insulated electrical conductors, said helically wound shielding member comprising: an elongated ribbon of insulating material having two opposite sides and two parallel edges; and a pair of elongated metallic foil strips arranged in a parallel relationship with the ribbon, each strip having two opposite sides and two parallel edges, with a respective side of each strip bonded to a respective one of the opposite sides of the ribbon, one of the edges of one of the foil strips being substantially coterminus with one edge of the elongated ribbon, and one of the edges of the other of the foil strips being substantially coterminus with the other edge of the elongated ribbon, the width of each of the foil strips being approximately one half the width of the ribbon, and each of the other edges of the foil strips slightly overlapping one another, said ribbon being helically wound about said insulated electrical conductors with each of said foil strips surrounding and forming a shielding envelope about said insulated electrical conductors.

2. An electric cable comprising: a pair of cable circuits each containing one or more conductors; a shielding member comprising an elongated ribbon of insulating material and a pair of elongated metallic foil strips arranged in a parallel relationship with the ribbon and bonded to opposite sides of the ribbon, the width of each of the foil strips being less than the width of the ribbon, and each of the foil strips having an outer elongated edge generally in alignment with opposite elongated edges of the ribbon, the shielding member being folded in a generally S-shaped configuration forming two envelopes, each of the cable circuits being encased in one of the respective envelopes; and an overlying outer jacket.

3. The electric cable of claim 2 wherein each of the cable circuits is substantially surrounded by one of the respective foil strips thereby electrically isolating the cable circuits.

4. The electric cable of claim 3 wherein each of the foil strips has an inner elongated edge, the inner elongated edges of the foil strips extending over a common portion along the length of the ribbon in an offset relationship.

5. The electric cable of claim 3 or 4 wherein the cable circuits are helically twisted about each other with the shielding member correspondingly helically twisted about the cable circuits.

6. The electric cable of claim 5 wherein the shielding member is folded in a generally S-shaped configuration with each of the foil strips turned inward in one of the respective envelopes.

7. The electric cable of claim 6 wherein an outer elongated edge of each foil strip contacts the inner elongated edge of the respective foil strip along the length of the shielding member.

8. The electric cable of claim 7 further comprising a pair of drain wires, one extending along and encased inside each of the respective envelopes.

9. The electric cable of claim 7 wherein each outer elongated edge of the shielding member is folded outward in a shorting fold.

10. The electric cable of claim 9 further comprising a pair of drain wires each extending along an interstice formed between the shorting fold and the respective inner edge of the respective foil strip.

11. The electric cable of claim 5 wherein the shielding member is folded in a generally S-shaped configuration with each of the foil strips turned outward in a respective one of the envelopes.

12. The electric cable of claim 11 wherein each of the outer elongated edges of the shielding member is folded under in a shorting fold so that an outer elongated edge of each of the foil strip contacts the inner elongated edge of the outer foil strip.

13. The electric cable of claim 11 further comprising one or more drain wires extending along and in contact with an exposed surface of at least one of the foil strips.

* * * * *